US010839776B1

(12) United States Patent
Liao

(10) Patent No.: US 10,839,776 B1
(45) Date of Patent: Nov. 17, 2020

(54) FAST FOLDING STRUCTURE OF PEDAL PERCUSSION DEVICE

(71) Applicant: Tsun-Chi Liao, Taichung (TW)

(72) Inventor: Tsun-Chi Liao, Taichung (TW)

( * ) Notice: Subject to any disclaimer, the term of this patent is extended or adjusted under 35 U.S.C. 154(b) by 0 days.

(21) Appl. No.: 16/749,251

(22) Filed: Jan. 22, 2020

(51) Int. Cl.
*G10D 13/11* (2020.01)
*G10D 13/065* (2020.01)

(52) U.S. Cl.
CPC ..... *G10D 13/11* (2020.02); *G10D 13/065* (2013.01)

(58) Field of Classification Search
CPC ..... G10D 13/11; G10D 13/065
See application file for complete search history.

(56) References Cited

U.S. PATENT DOCUMENTS 6,188,007 B1 2/2001 Liao
8,669,454 B1 * 3/2014 Lin ..... G10D 13/00 84/422.1

* cited by examiner

*Primary Examiner* — Kimberly R Lockett
(74) *Attorney, Agent, or Firm* — Muncy, Geissler, Olds & Lowe, P.C.

(57) ABSTRACT

A fast folding structure of pedal percussion device includes a pedal base, a rotating device, at least one locking rod, at least one elastic element, and a pressing rod, wherein the pedal base comprises at least one upright column comprises an installation hole; the rotating device is pivotally connected to the upright column and is rotatable to be in an upright state or a bent state; the locking rod is disposed in the installation hole; the elastic element is disposed in the installation hole, and the elastic element pushes the locking rod to lock into a first hole or a second hole to fix the rotating device; the pressing rod is fixed to the locking rod, and the pressing rod presses the locking rod to compress the elastic element so that the locking rod is disengaged from the first hole or the second hole without fixing the rotating device.

5 Claims, 8 Drawing Sheets

FAST FOLDING STRUCTURE OF PEDAL PERCUSSION DEVICE

FIELD OF THE INVENTION

The present invention relates to a pedal of percussion instrument, and more particularly to a fast folding structure of pedal.

BACKGROUND OF THE INVENTION

Cymbals are played by percussing an upper cymbal and a lower cymbal with each other. The conventional technique is to set the cymbals on a musical instrument stand and step on the pedal to drive the cymbals to percuss each other and make a sound. Since the pedal and the musical instrument stand are L-shaped, a considerable amount of space is occupied during storage, and it is quite inconvenient to transport and easy to cause damage due to carelessness.

Therefore, U.S. Pat. No. 6,188,007B1 provides a foldable musical instrument pedal structure. The pedal of which is collapsed to be parallel to the musical instrument stand to achieve the efficacy of space-saving for storage.

However, the above-mention conventional structure is quite cumbersome to operate since the pedal requires loosening and locking the locking bolts whenever it needs to be collapsed. Thus, the conventional structure cannot be quickly collapsed. In addition, the collapsed pedal of the conventional structure is in an upright standing state, and thus when the foldable musical instrument pedal is stored, it is easy to be damaged due to impact from toppling.

SUMMARY OF THE INVENTION

Therefore, a main object of the present invention is to provide a fast folding structure of pedal.

In order to achieve the above object, the present invention provides a fast folding structure of pedal percussion device, which includes a pedal base, a rotating device, at least one locking rod, at least one elastic element, and a pressing rod, wherein the pedal base comprises at least one upright column, and each of the at least one upright column comprises an installation hole. The rotating device is pivotally connected to each of the at least one upright column so that the rotating device has an upright state and a bent state by rotating. The rotating device comprises at least one first hole which is faced to the installation hole in the upright state, and at least one second hole which is faced to the installation hole in the bent state. Each of the at least one locking rod is disposed in the installation hole. Each of the at least one elastic element is disposed in the installation hole, when the rotating device is in the upright state, each of the at least one elastic element pushes the locking rod to lock into the first hole. When the rotating device is in the bent state, each of the at least one elastic element pushes the locking rod to lock into the second hole. The pressing rod is fixed to each of the at least one locking rod, and the pressing rod presses each of the at least one locking rod to compress the elastic element so that each of the at least one locking rod is disengaged from the first hole or the second hole.

Accordingly, through the pressing rod presses the locking rod to compress the elastic element, the locking rod can be disengaged from the first hole or the second hole, and the rotating device is rotatable to be in the bent state or the upright state to meet the requirements of fast folding.

DETAILED DESCRIPTION OF THE PREFERRED EMBODIMENTS

The detailed description and technical contents of the present invention are described below with reference to the drawings.

Figure 1:
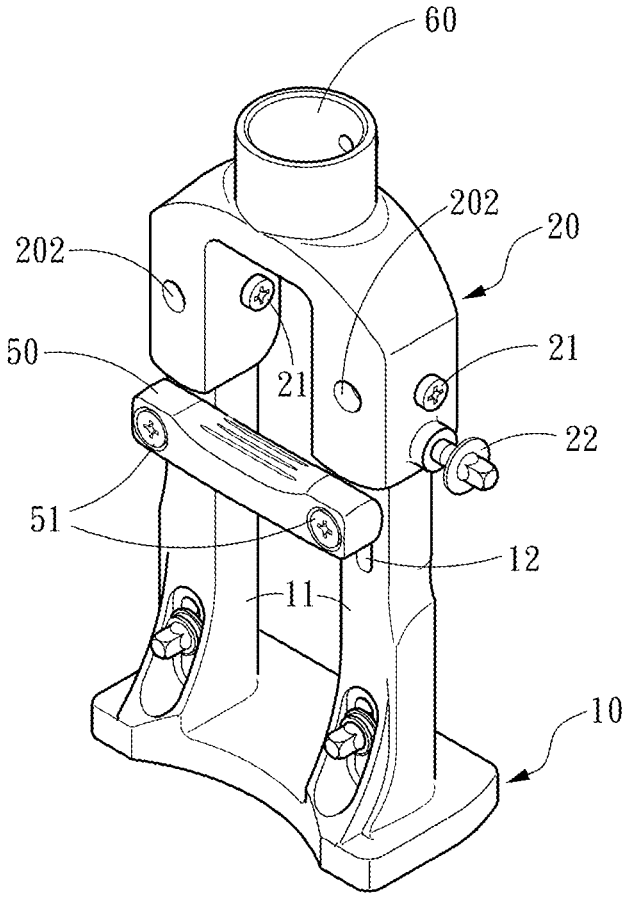
FIG. 1 is a perspective assembly view of a fast folding structure of pedal percussion device of the present invention.
Figure 2:
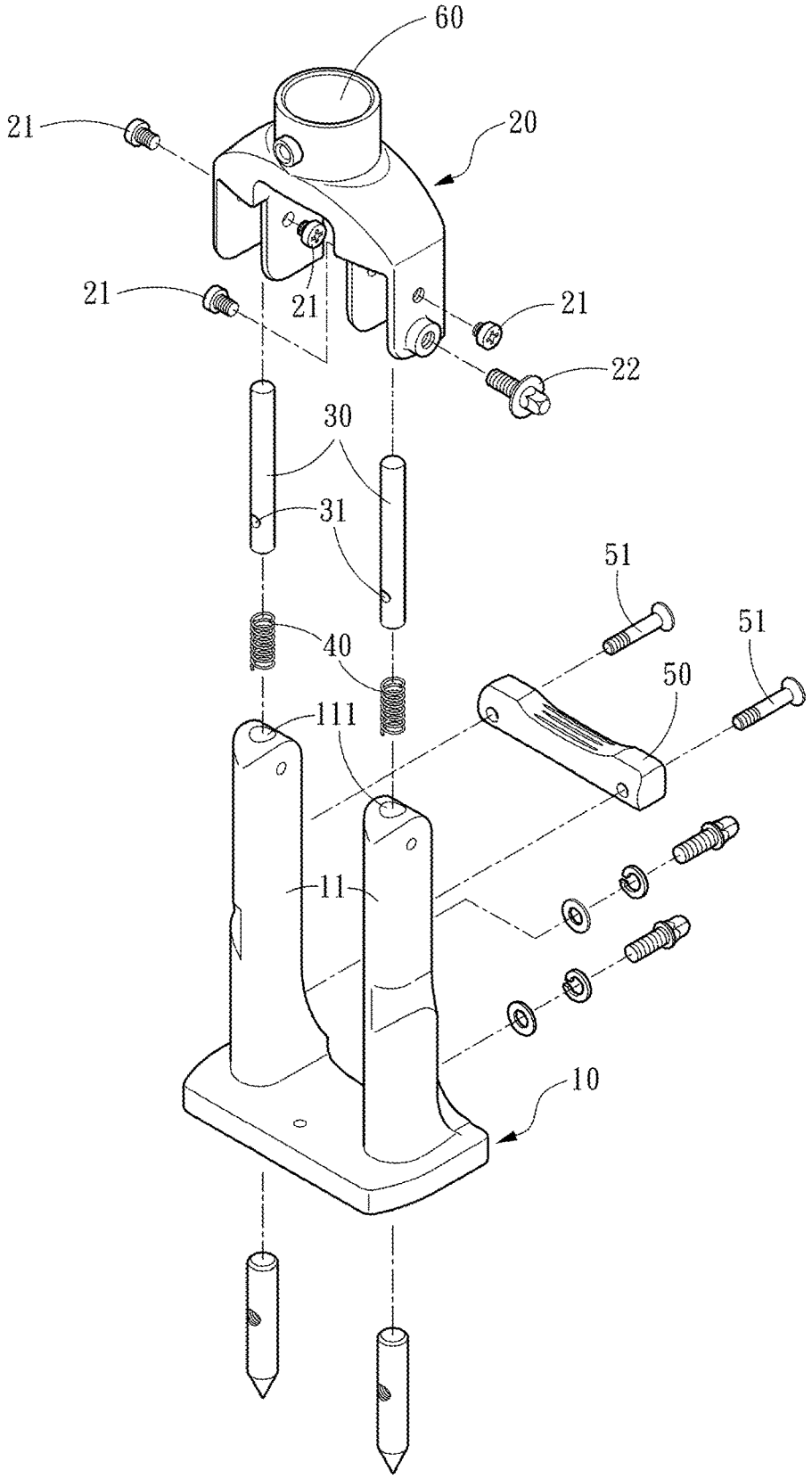
FIG. 2 is a perspective exploded view of the fast folding structure of pedal percussion device of the present invention.

Please refer to FIG. 1 and FIG. 2. The present invention provides a fast folding structure of pedal percussion device, which includes a pedal base 10, a rotating device 20, at least one locking rod 30, at least one elastic element 40, and a pressing rod 50. The pedal base 10 comprises at least one upright column 11, and each upright column 11 comprises an installation hole 111.

Figure 3A:
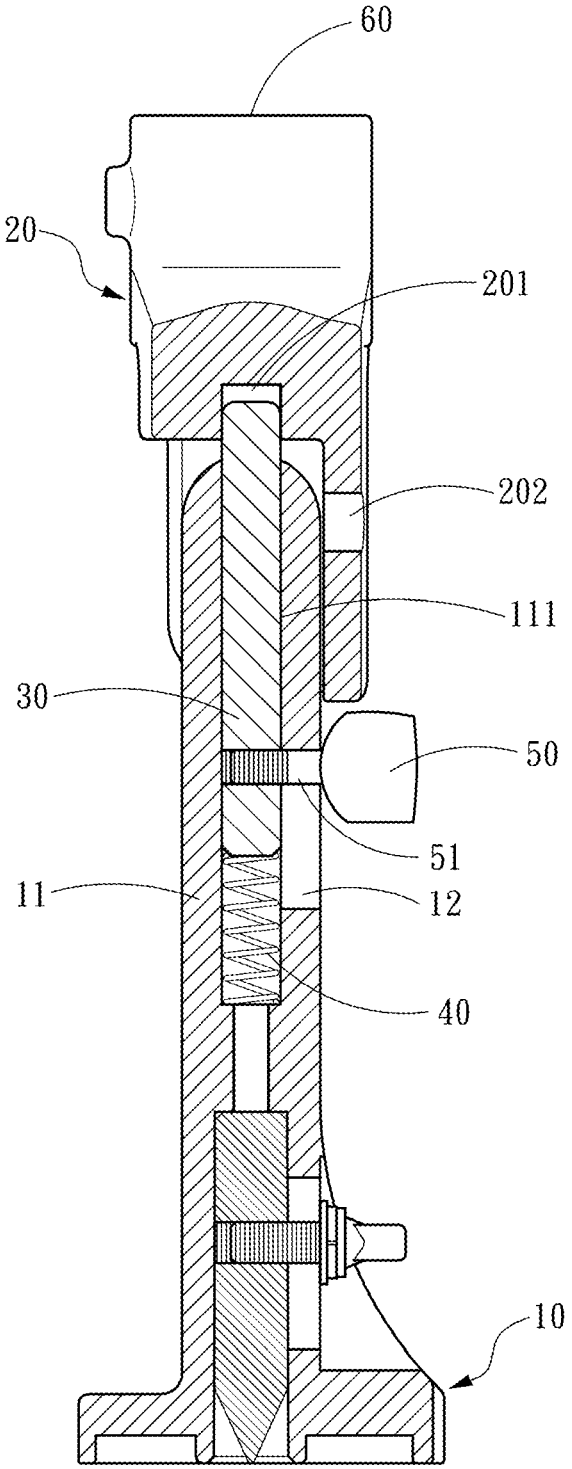
FIG. 3A is a cross-sectional view of the present invention when a rotating device is in an upright state.
Figure 3B:
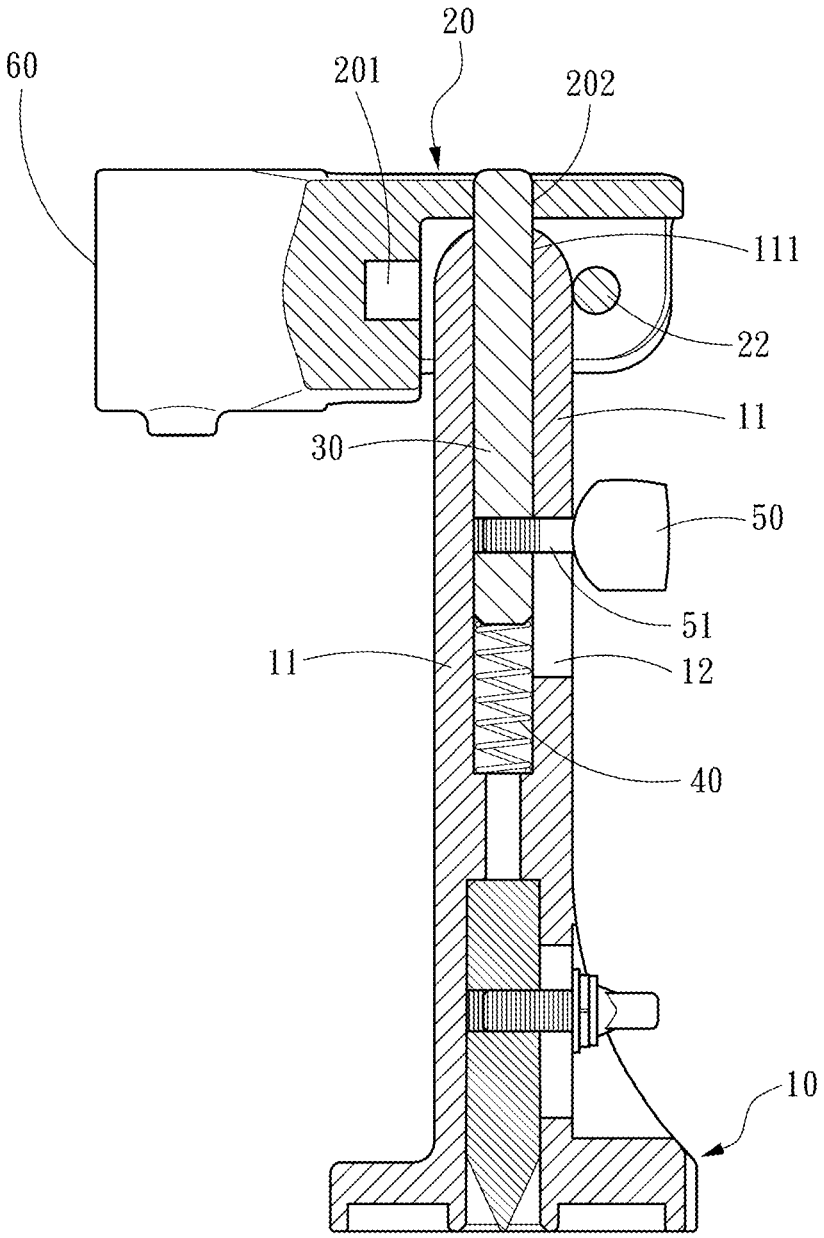
FIG. 3B is a cross-sectional view of the present invention when the rotating device is in a bent state.

Please refer to FIG. 1, FIG. 2, FIG. 3A and FIG. 3B, the rotating device 20 is pivotally connected to each upright column 11, wherein the rotating device 20 is pivotally connected to each upright column 11 through at least one pivot 21. The rotating device 20 covers the upright column 11, and the rotating device 20 is locked to the upright column 11 through at least one pivot 21 passing through the rotating device 20 coaxially from both sides the rotating device 20, thereby the rotating device 20 is pivotally connected to the upright column 11. The rotating device 20 has an upright state (as shown in FIG. 3A) and a bent state (as shown in FIG. 3B) by rotating. The rotating device 20 comprises at least one first hole 201 which is faced to the installation hole 111 in the upright state, and the rotating device 20 also comprises at least one second hole 202 which is faced to the installation hole 111 in the bent state. Each locking rod 30 is disposed in the installation hole 111. Each elastic element 40 is disposed in the installation hole 111, when the rotating device 20 is in the upright state, each elastic element 40 pushes the locking rod 30 to lock into the first hole 201. When the rotating device 20 is in the bent state, each elastic element 40 pushes the locking rod 30 to lock into the second hole 202.

Figure 3C:
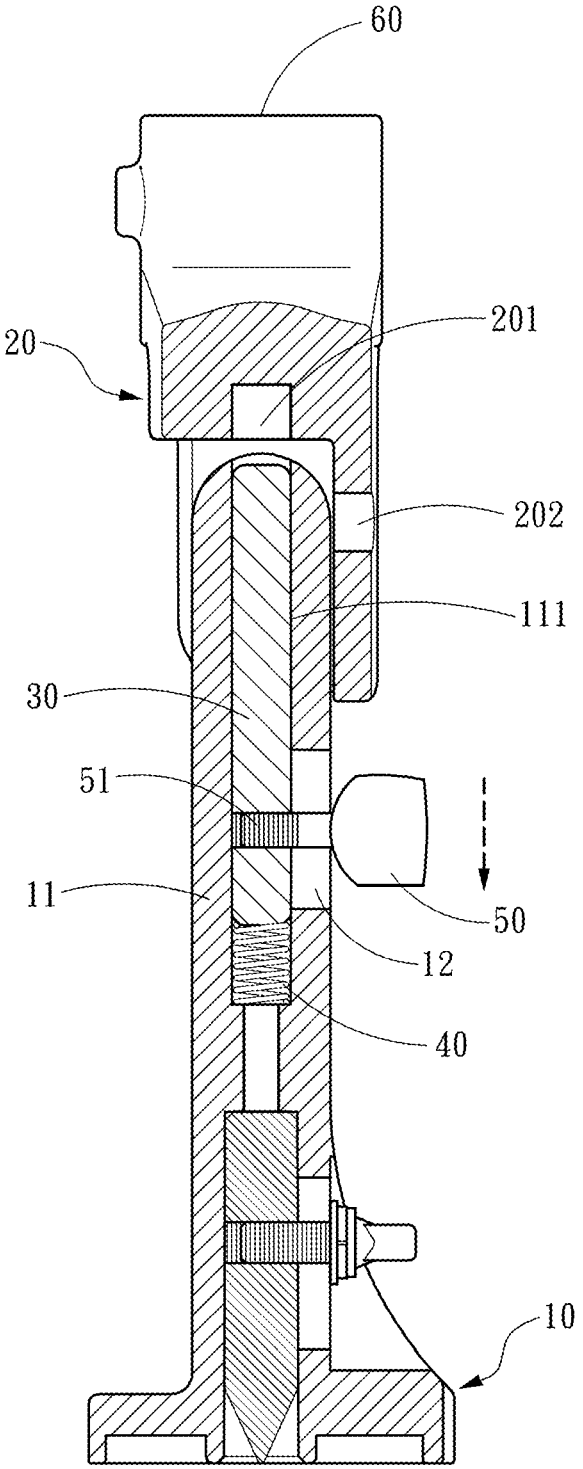
FIG. 3C is a cross-sectional view of the present invention with an elastic element compressed when the rotating device is in the upright state.
Figure 3D:
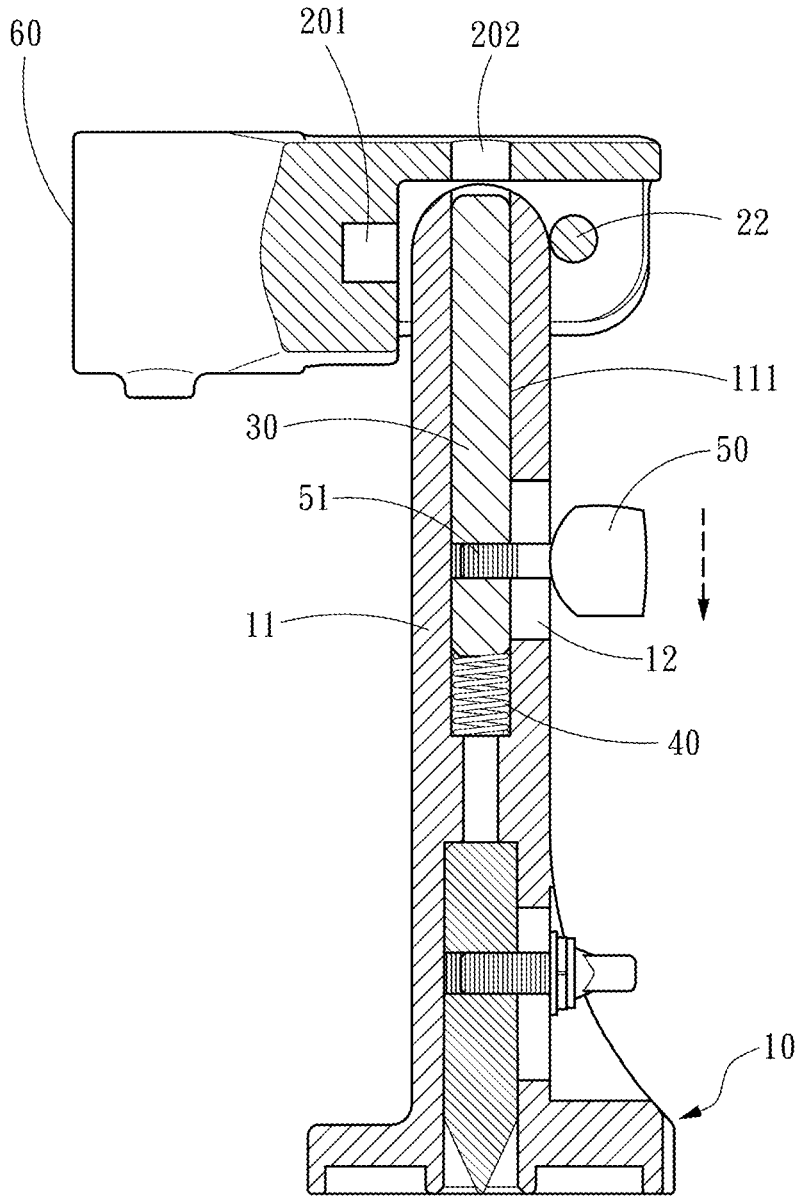
FIG. 3D is a cross-sectional view of the present invention with the elastic element compressed when the rotating device is in the bent state.

Please refer to FIG. 1, FIG. 2, FIG. 3C and FIG. 3D, the pressing rod 50 is fixed to each locking rod 30. Each upright column 11 comprises a side opening 12. Through a bolt 51 passes through the side opening 12, the pressing rod 50 is fixed on the each locking rod by at least one bolt 51 passing through the side opening 12 and being fixed in a locking hole 31 of the locking rod 30, and the pressing rod 50 presses each locking rod 30 to compress each elastic element 40. Therefore, each locking rod 30 is disengaged from the first hole 201 (as shown in FIG. 3C) or the second hole 202 (as shown in FIG. 3D).

In addition, the rotating device 20 is provided with a fixing bolt 22, when the rotating device 20 is in the bent state, the fixing bolt 22 is fixed in the upright column 11 so that the rotating device 20 cannot rotate relative to each upright column 11, and thus the rotating device 20 does not rotate unexpectedly during transportation.

Figure 4:
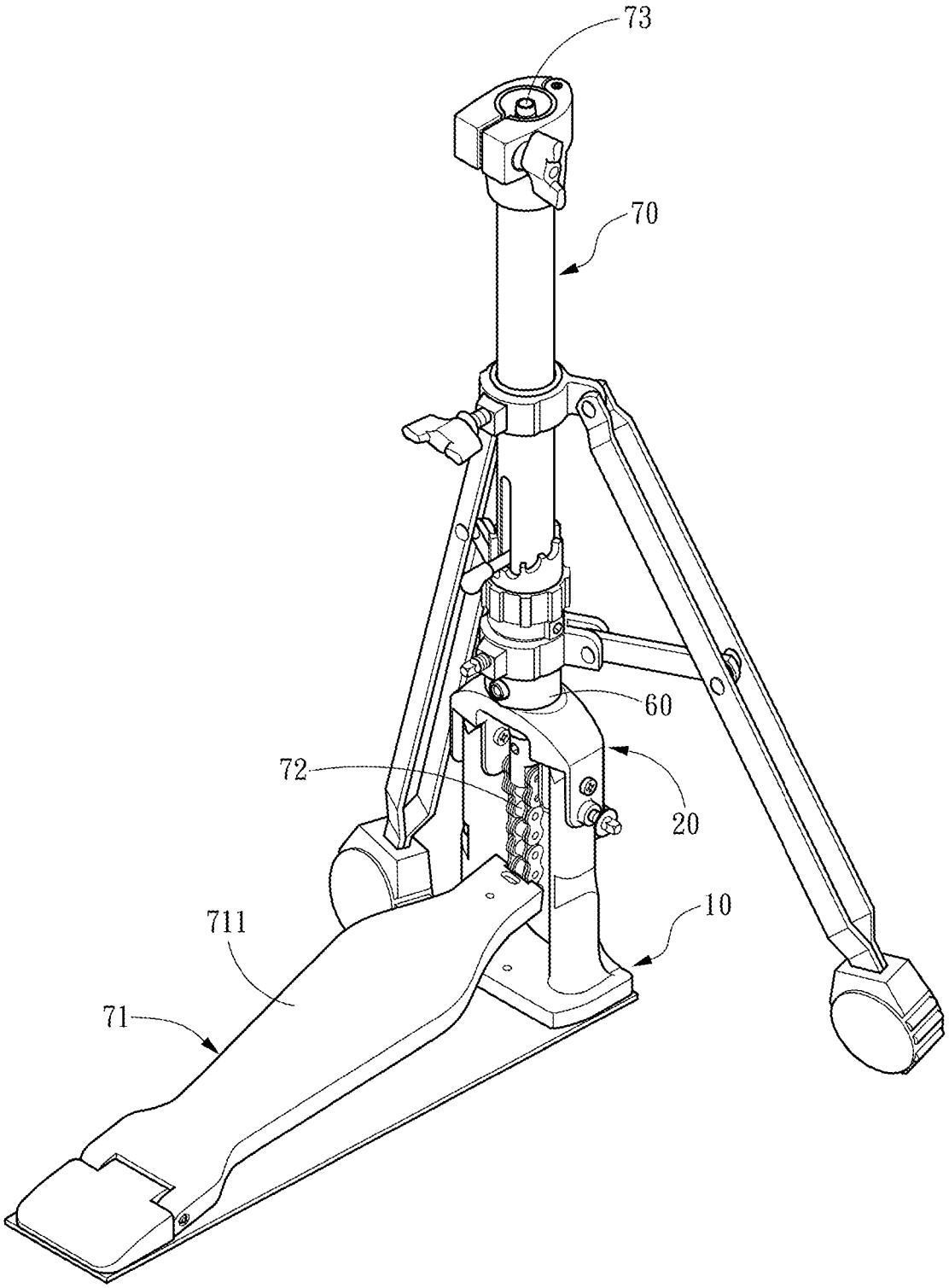
FIG. 4 is a perspective view of the present invention when the fast folding structure of pedal percussion device is used.

Please refer to FIG. 4, when the rotating device 20 is in the upright state, the rotating device 20 comprises a locking tube 60 disposed facing upwardly, the locking tube 60 is used for locking a musical instrument stand 70. The pedal base 10 is disposed on a foot pedal 71, the foot pedal 71 comprises a pedal 711, and the pedal 711 drags a driving rod 73 through a traction element 72, so that the driving rod 73 is displaced to drive cymbals (not shown in the figure) to make a sound.

Figure 5:
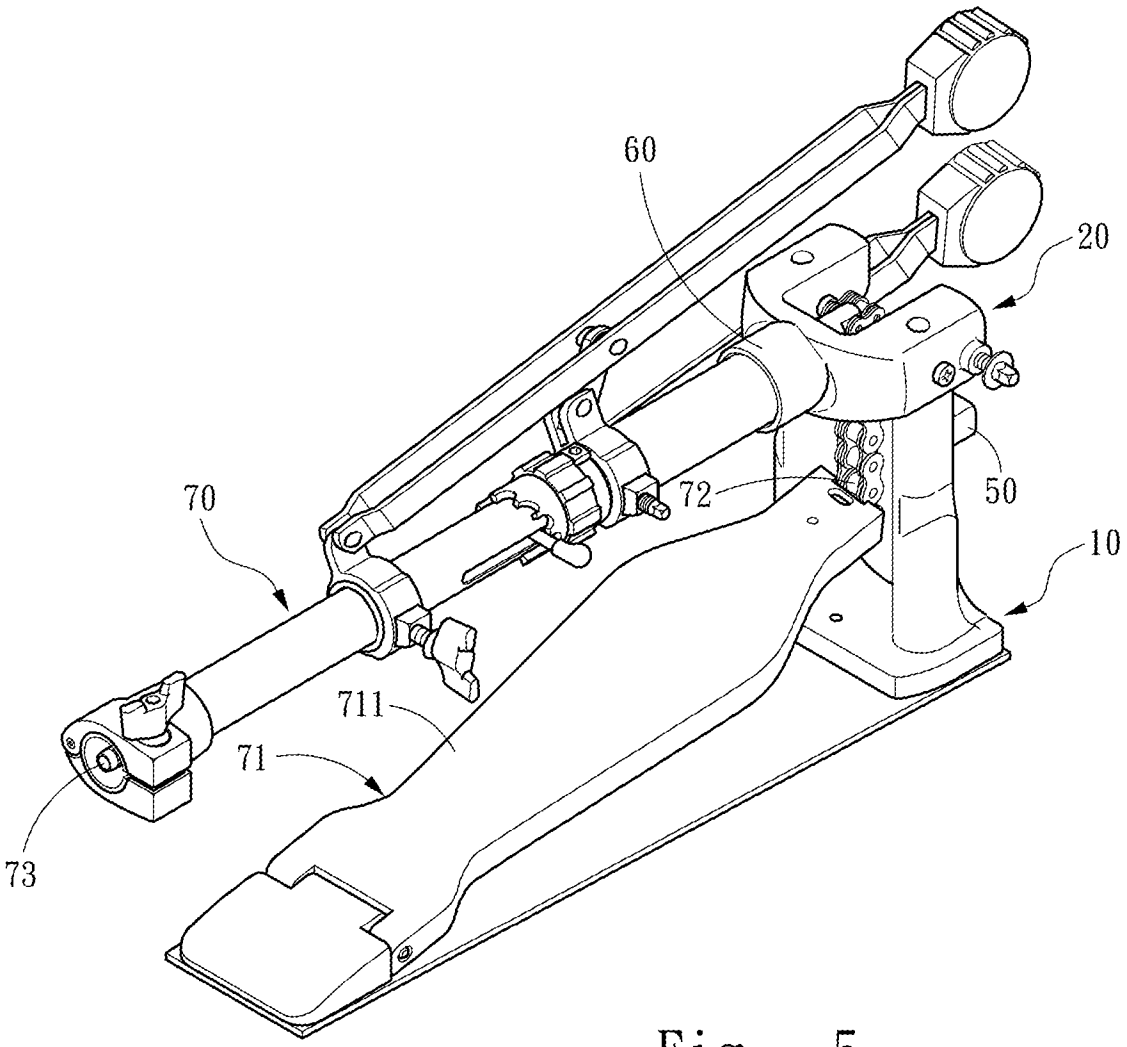
FIG. 5 is a perspective view of the present invention when the fast folding structure of pedal percussion device is folded.

Please refer to FIG. 5, when the folding structure of pedal percussion device needs to be folded, as shown in FIG. 3C, press the pressing rod 50 to disengage the locking rod 30 from the first hole 201, the rotating device 20 can be turned from the upright state to the bent state, and folding is complete after the musical instrument stand 70 is collapsed.

According to the above-mentioned, the present invention has the following features:

1. By pressing the pressing rod, the rotating device is rotatable to meet the requirements of fast folding.

2. The rotating device is folded horizontally, thereby preventing the damage caused by toppling.

What is claimed is:

1. A fast folding structure of a pedal percussion device including:

a pedal base, comprising at least one upright column, and each of the at least one upright column comprising an installation hole;

a rotating device, pivotally connected to each of the at least one upright column so that the rotating device has an upright state and a bent state by rotating, the rotating device comprising at least one first hole which is faced to the installation hole in the upright state and at least one second hole which is faced to the installation hole in the bent state;

at least one locking rod, each of the at least one locking rod disposed in the installation hole;

at least one elastic element, each of the at least one elastic element disposed in the installation hole, when the rotating device in the upright state, each of the at least one elastic element pushing the locking rod to lock into the first hole, and when the rotating device in the bent state, each of the at least one elastic element pushing the locking rod to lock into the second hole; and a pressing rod, the pressing rod fixed to each of the at least one locking rod, and the pressing rod pressing each of the at least one locking rod to compress the elastic element so that each of the at least one locking rod is disengaged from the first hole or the second hole.

2. The fast folding structure of pedal percussion device as claimed in claim 1, wherein each of the at least one upright column comprises a side opening, and the pressing rod is fixed on the at least one locking rod by at least one bolt passing through the side opening and being fixed in a locking hole of the locking rod.

3. The fast folding structure of pedal percussion device as claimed in claim 1, wherein the rotating device is pivotally connected to each of the at least one upright column through at least one pivot.

4. The fast folding structure of pedal percussion device as claimed in claim 1, wherein the rotating device is provided with a fixing bolt, when the rotating device is in the bent state, the fixing bolt is fixed in the upright column so that the rotating device cannot rotate relative to each of the at least one upright column.

5. The fast folding structure of pedal percussion device as claimed in claim 1, wherein when the rotating device is in the upright state, the rotating device comprises a locking tube disposed facing upwardly.

* * * * *